US007461588B2

(12) United States Patent
Head

(10) Patent No.: US 7,461,588 B2
(45) Date of Patent: Dec. 9, 2008

(54) METHODS AND APPARATUS FOR OPERATING A SPEEDCOOKING OVEN

(75) Inventor: Jesse Spalding Head, Louisville, KY (US)

(73) Assignee: General Electric Company, Schenectady, NY (US)

( * ) Notice: Subject to any disclaimer, the term of this patent is extended or adjusted under 35 U.S.C. 154(b) by 808 days.

(21) Appl. No.: 10/930,489

(22) Filed: Aug. 31, 2004

(65) Prior Publication Data

US 2006/0047344 A1 Mar. 2, 2006

(51) Int. Cl.
*H05B 1/02* (2006.01)
*A21B 1/40* (2006.01)
*F27D 19/00* (2006.01)

(52) U.S. Cl. ..... 99/326; 99/332; 219/412; 219/492; 219/506

(58) Field of Classification Search ..... None
See application file for complete search history.

(56) References Cited

U.S. PATENT DOCUMENTS 3,569,656 A 3/1971 White et al.
4,369,347 A 1/1983 Shin
4,568,810 A 2/1986 Carmean
4,661,670 A 4/1987 Eke
4,968,864 A 11/1990 Doi et al.
5,695,669 A 12/1997 Westerberg
5,877,477 A 3/1999 Petty et al.
5,981,915 A 11/1999 Head
6,333,492 B1 * 12/2001 Graves et al. ..... 219/413
6,388,238 B2 5/2002 Head
6,525,301 B1 2/2003 Graves et al.
6,528,772 B1 3/2003 Graves et al.
6,538,240 B1 3/2003 Shon et al.
6,670,591 B2 12/2003 Shon et al.
6,730,830 B2 5/2004 Eby
6,730,889 B1 5/2004 Jones-Lawlor
6,936,801 B1 * 8/2005 Head ..... 219/506
2003/0024925 A1 2/2003 Graves et al.

* cited by examiner

*Primary Examiner*—Joseph M Pelham
(74) *Attorney, Agent, or Firm*—George L. Rideout, Esq.; Armstrong Teasdale LLP

(57) ABSTRACT

A method of operating a cooking appliance including an input interface panel and a processor includes: inputting a first cooking time and a first cooking power level; manually changing the first cooking time such that the first cooking time is either extended or shortened; and automatically determining the actual cooking time using the processor.

17 Claims, 4 Drawing Sheets

METHODS AND APPARATUS FOR OPERATING A SPEEDCOOKING OVEN

BACKGROUND OF THE INVENTION

This invention relates generally to a cooking appliance, and, more particularly, to a cooking appliance with a custom recipe feature.

Electronic, touch sensitive, glass control interfaces are becoming increasingly popular in modern range ovens to control a variety of cooking elements, including but not limited to a bake element and a broil element in a cabinet cooking cavity. Known electronic controls have facilitated oven features and modes of baking operation not found in conventional mechanically controlled ranges. Known control interfaces to implement these features, however, tend to be cumbersome and difficult to new users, and tedious and time consuming for other users.

For example, at least some known ovens include a feature wherein an operator may create a custom recipe by inputting a desired cooking time and a desired power level based on trial and error to determine the optimized cooking time for the recipe. However, determining an optimal cooking time for a specific recipe often requires the operator to perform a plurality of cooking iterations to determine the optimized cooking time. More specifically, the operator may have to repeat the same recipe using multiple power levels and multiple cooking times before the operator can determine an optimal cooking time and power level to create a recipe that includes the optimum taste desired by the operator. Repeating the same recipe may be time consuming for the operator, and may also result in an increase in cost for cooking supplies used by the operator to create the recipe.

BRIEF DESCRIPTION OF THE INVENTION

In one aspect, a method of operating a cooking appliance including an input interface panel and a processor is provided. The method includes inputting a first cooking time and a first cooking power level, manually changing the first cooking time such that the first cooking time is either extended or shortened, and automatically determining the actual cooking time using the processor.

In another aspect, a computer for operating a cooking appliance is provided. The computer is programmed to receive a first cooking time input and a first cooking power level input, and receive a second cooking time input that is based on an operator manually changing the first cooking time, such that the first cooking time is either extended or shortened. The computer is also programmed to automatically determine an actual cooking time.

In a further aspect, a cooking appliance including at least one cooking element and a computer electrically coupled to the at least one cooking element is provided. The computer is programmed to receive a first cooking time input and a first cooking power level input, and receive a second cooking time input that is based on an operator manually changing the first cooking time, such that the first cooking time is either extended or shortened. And the computer automatically determines an actual cooking time.

DETAILED DESCRIPTION OF THE INVENTION

Figure 1:
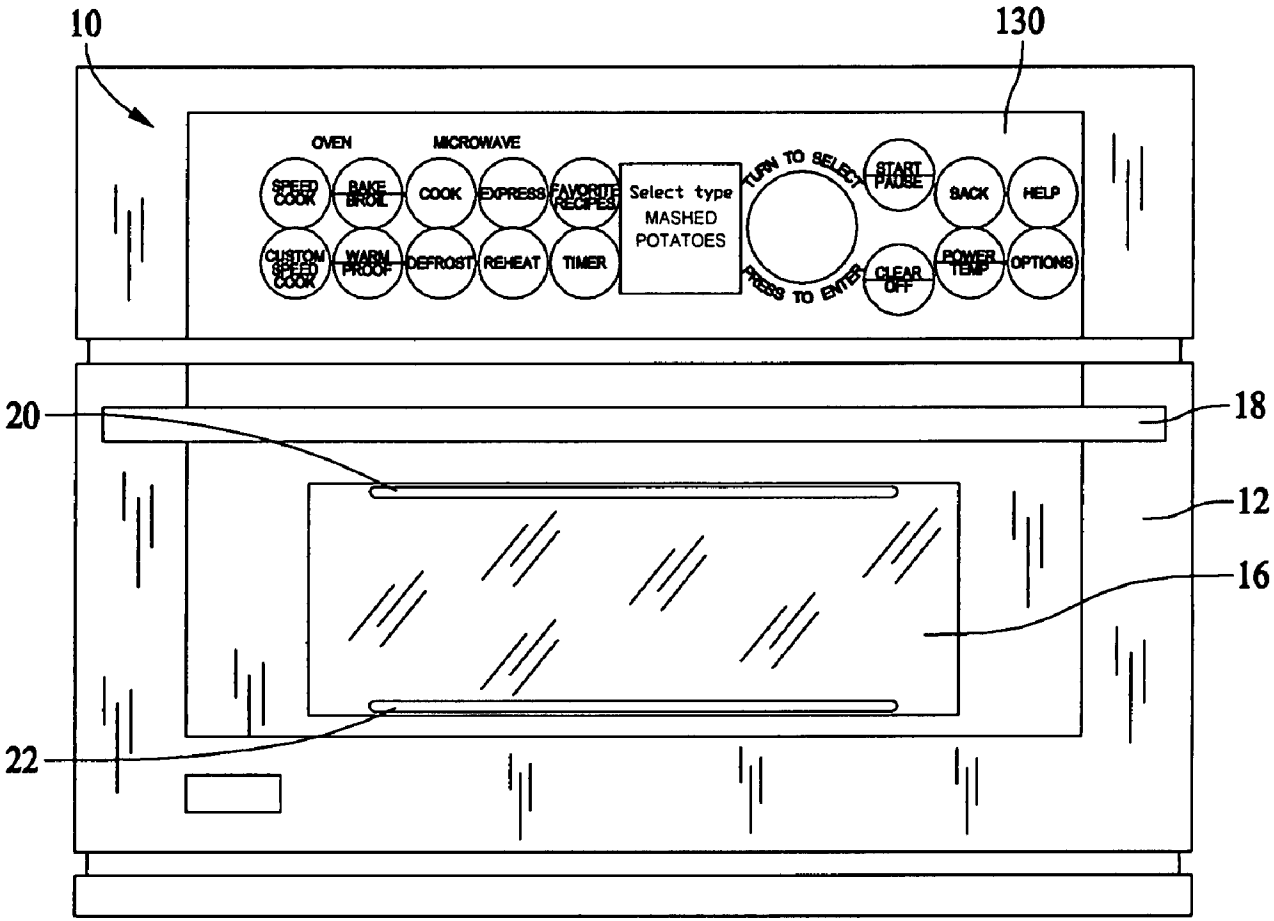
FIG. 1 is a front view of an exemplary oven.

FIG. 1 is a front view of an exemplary cooking appliance 10 including a front-opening access door 12 and an oven input interface panel 130. Door 12 includes a window 16 and a handle 18. An upper heating element 20 and a lower heating element 22 are positioned within cooking appliance 10. It is contemplated that the present invention is applicable, not only to, free-standing ovens, such as cooking appliance 10, but to other forms of ranges as well, such as, but not limited to, oven disposed at a lower portion of a range. In addition, it is contemplated that the present invention is applicable to duel fuel cooking appliances, e.g., a gas cooktop with an electric oven.

Figure 2:
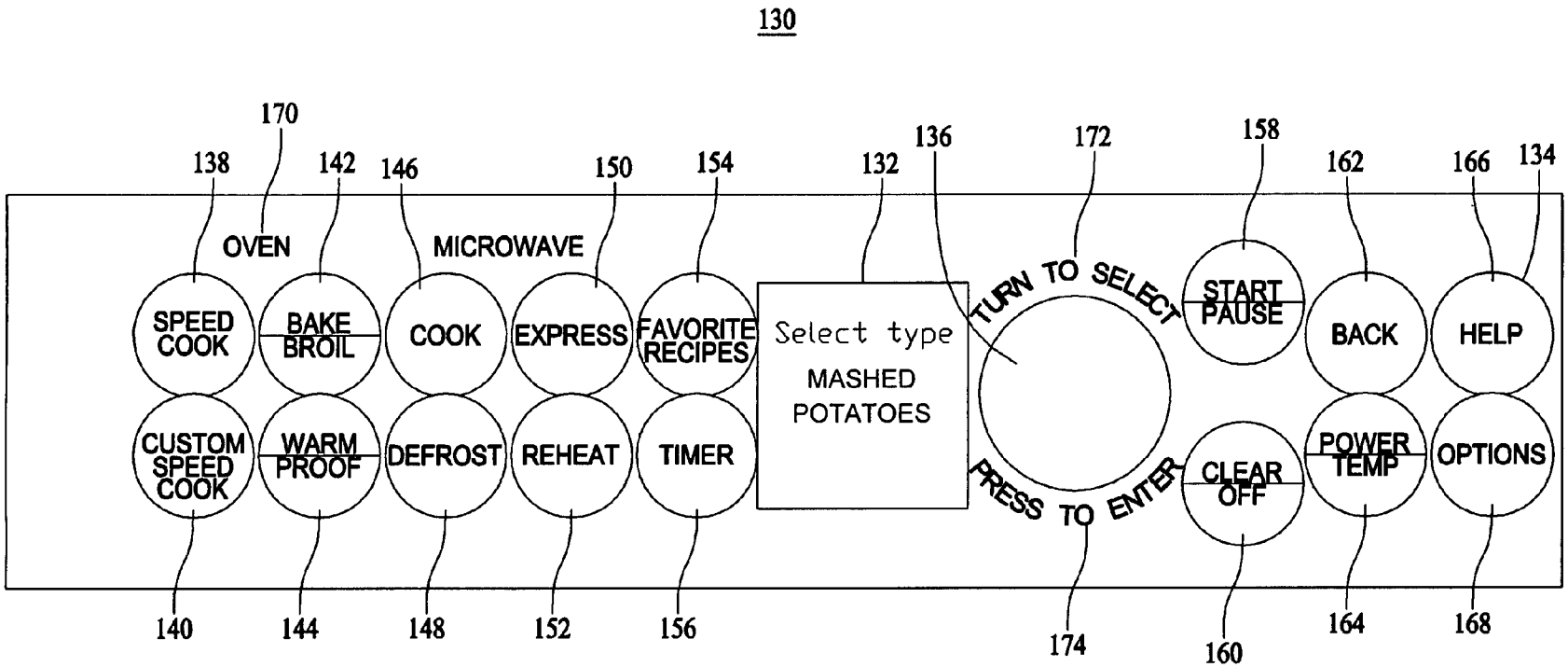
FIG. 2 is a plan view of a control panel interface for the range shown in FIG. 1.

FIG. 2 illustrates an exemplary input interface panel 130 for cooking appliance 10 (shown in FIG. 1). Interface panel 130 includes a display 132, a dial 136, and a plurality of input selectors 134 in the form of touch sensitive buttons or keypads for accessing and selecting oven features. In alternative embodiments, other known input selectors are used in lieu of touch sensitive switches.

More specifically, input selectors 134 include a SPEED COOK keypad 138, a CUSTOM SPEED COOK keypad 140, a BAKE/BROIL keypad 142, a WARM/PROOF keypad 144, a COOK keypad 146, a DEFROST keypad 148, a EXPRESS keypad 150, a REHEAT keypad 152, a FAVORITE RECIPES keypad 154, a TIMER keypad 156, a START/PAUSE keypad 158, a CLEAR/OFF keypad 160, a BACK keypad 162, a POWER/TEMP keypad 164, a HELP keypad 166, and a OPTIONS keypad 168. Interface panel 130 further includes an OVEN icon 170 positioned above SPEED COOK keypad 138 and BAKE/BROIL keypad 142, and a TURN TO SELECT icon 172 and a PRESS TO ENTER icon 174 respectively positioned above and below dial 136 for prompting an operator to manipulate dial 136.

Figure 3:
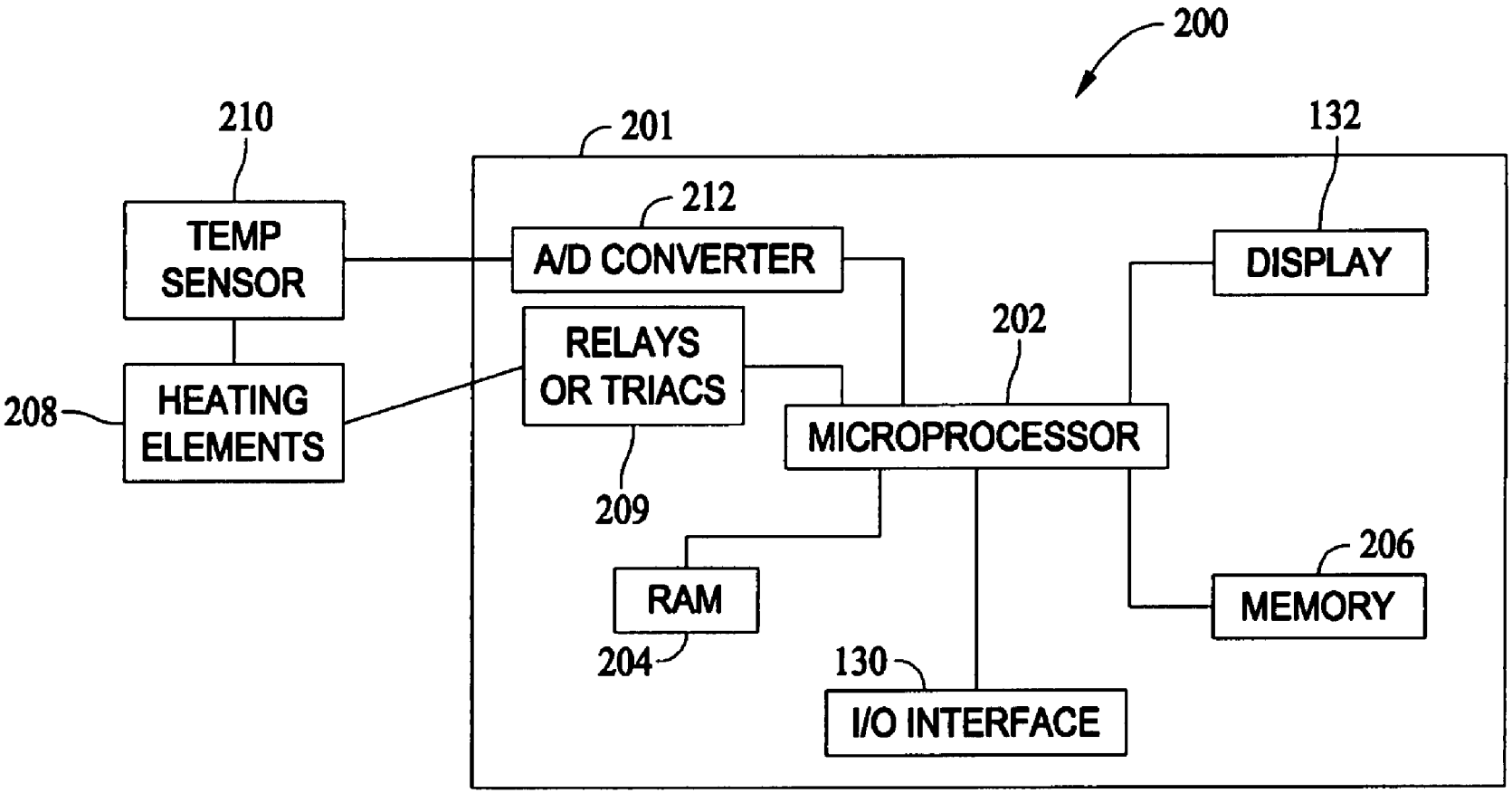
FIG. 3 is a schematic block diagram of a control system for the range shown in FIG. 1.

By manipulating the appropriate input selector 134, the appropriate feature or function is activated by an appliance controller (shown in FIG. 3). For most of the features, an icon or indicator is displayed on display 132 to visually indicate selected appliance features and operating parameters, such as cooking time, cooking temperature, etc. In an exemplary embodiment, rotating dial 136 adjusts parameters of the selected appliance feature, and pressing dial 136 enters the adjusted parameters.

FIG. 3 is a block diagram of a control system 200 that may be used with range 10 (shown in Figure). Control system 200 includes a controller 201 that includes a microprocessor 202 that is coupled to input interface 130 and to display 132, and including a RAM memory 204 and a permanent memory 206, such as a flash memory (FLASH), a programmable read only memory (PROM), an erasable programmable read only memory (EPROM), or an electrically erasable programmable read only memory (EEPROM) as known in the art. The controller memory is used to store calibration constants, oven operating parameters, cooking routine, and recipe information that may be used to control the oven heating elements and execute user instructions.

Figure 4:
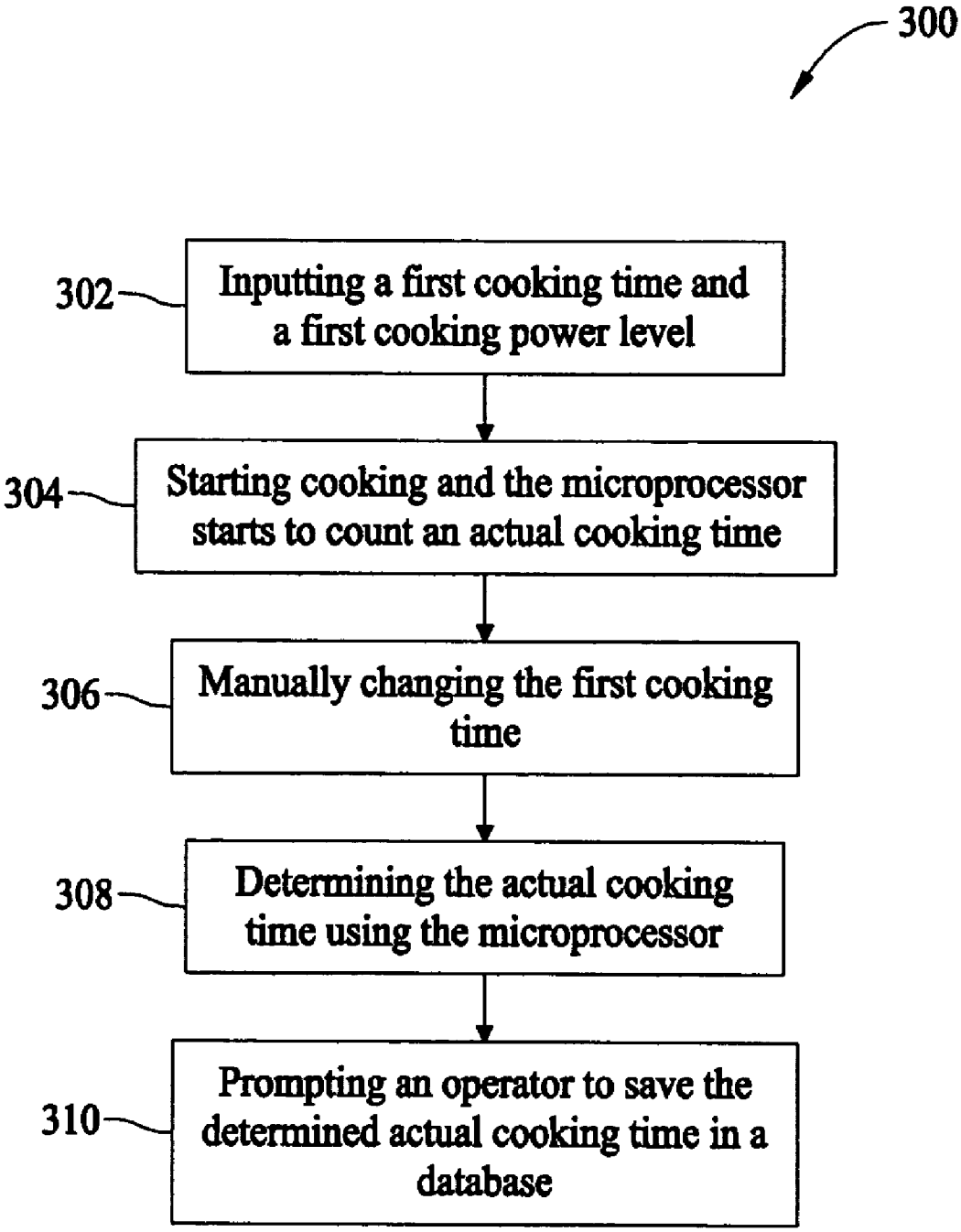
FIG. 4 illustrates a flow chart for a method of operating the range shown in FIG. 1.

Microprocessor 202 is operatively coupled to a plurality of electrical heating elements 208 (i.e., oven bake element, broil element, convection element, and cooktop surface heating units) for energization thereof through relays, triacs, 209 or other known mechanisms (not shown) for cycling electrical power to oven heating elements 208. One or more temperature sensors 210 sense operating conditions of oven heating elements 208 and are coupled to an analog to digital converter (A/D converter) 212 to provide a feedback control signal to microprocessor 202. It is contemplated also that gas heating elements may be employed for oven operation in alternative embodiments of the invention FIG. 4 illustrates a flow chart of an exemplary method 300 of operating cooking appliance 10 (shown in FIG. 1). Method 300 includes inputting 302 a first cooking time and a first cooking power level, starting cooking 304 and microprocessor 202 (shown in FIG. 3) starting to count an actual cooking time, manually changing 306 the first cooking time, determining 308 the actual cooking time using microprocessor 202, and prompting 310 an operator to save the determined actual cooking time in a database.

In an exemplary embodiment, in step 302, when SPEED COOK keypad 138 (shown in FIG. 2) is pressed, OVEN icon 170 (shown in FIG. 2) will be lit, and TURN TO SELECT icon 172 (shown in FIG. 2) will flash to prompt the operator to manipulate dial 136 (shown in FIG. 2). "Select COOK TIME" is displayed on display 132 (shown in FIG. 2) at the first line, and the first cooking time is also displayed on display 132 as a predetermined value at the second line. More specifically, the first cooking time is first displayed on display 132 in a MMM:SS time format as "000:15". The first cooking time displayed on display 132 is adjusted by rotating dial 136. Rotating dial 136 in a clockwise direction increases the first cooking time, and rotating dial 136 in a counter-clockwise direction decreases the first cooking time. More specifically, rotation of dial 136 changes the first cooking time 15 seconds per step when the first cooking time is within time range 000:15 to 010:00, and changes the first cooking time 30 seconds per step when the first cooking time is within time range 010:15 to 020:00, and so on. After the cooking time is adjusted, pressing dial 136 inputs the first cooking time.

After the first cooking time is inputted, dial 136 (shown in FIG. 2) is rotated to input the first cooking power level. More specifically, after the first cooking time is inputted by pressing dial 136, "Select UPPER POWER" is displayed on display 132 (shown in FIG. 2) at the first line, and an upper power level of upper heating element 20 (shown in FIG. 1) is first displayed on display 132 as "LO" at the second line. The upper power level displayed on display 132 is altered by rotating dial 136, and the upper power level is changeable between LO, MED LO, MED, MED HI, and HI. Rotating dial 136 in a clockwise direction increases the upper power level, and rotating dial 136 in a counter-clockwise direction decreases the upper power level. After the upper power level is adjusted, pressing dial 136 inputs the upper power level. After the upper power level is inputted, "Select LOWER POWER" is displayed on display 132 at the first line to prompt the operator to input setting of lower heating element 22 (shown in FIG. 1). The setting of lower heating element 22 can be input by manipulating dial 136 in a similar way. More specifically, a lower power level of lower heating element 22 is first displayed on display 132 as "LO" at the second line. The lower power level is changeable between LO and HI, rotating dial 136 alters the lower power level, and pressing dial 136 enters the lower power level such that the first cooking power level is inputted.

After inputting 302 the first cooking time and the first cooking power level, cooking appliance 10 (shown in FIG. 1) starts to cook by operator's appropriate manipulation, and microprocessor 202 (shown in FIG. 3) starts to count 304 the actual cooking time. More specifically, after the first cooking power level is inputted, "START WHEN READY" is displayed on display 132 (shown in FIG. 2) until cooking appliance 10 starts to cook. By pressing START/PAUSE keypad 158 (shown in FIG. 2) or dial 136 (shown in FIG. 2), cooking appliance 10 starts to cook, "CUSTOM COOK TIME" is displayed on display 132 at the first line, and microprocessor 202 starts to count the actual cooking time and display the actual cooking time on display 132 in a MMM:SS time format at the second line. The upper and lower power levels are also displayed on display 132 for several seconds.

In an exemplary embodiment, during the process of cooking, if the operator rotates dial 136 (shown in FIG. 2) to manually input a second cooking time, different than the first cooking time, microprocessor 202 (shown in FIG. 3) adds/subtracts the second cooking time input to/from the first cooking time depending on the operator's manipulation of dial 136, such that the first cooking time is extended or shortened. In another exemplary embodiment, when the originally inputted first cooking time is complete, cooking appliance 10 (shown in FIG. 1) will stop cooking, and the operator can activate a "resume" function of control system 200 (shown in FIG. 3) by manipulating the appropriate input selector 134. The "resume" function enables microprocessor 202 to add a second cooking time to the first cooking time, such that the first cooking time is extended and cooking appliance 10 continues to cook. Specifically, the second cooking time is at a predetermined percentage of the actual cooking time. More specifically, the second cooking time is set at about 10 percents of the actual cooking time.

By inputting the second cooking time during the process of cooking, or by adding the second cooking time to the first cooking time when the first cooking time is complete, the operator manually changes 306 the first cooking time. In an exemplary embodiment, when cooking appliance 10 (shown in FIG. 1) pauses in cooking, microprocessor 202 (shown in FIG. 3) stops counting the actual cooking time until cooking appliance 10 continues to cook. More specifically, if door 12 (shown in FIG. 1) is opened and cooking appliance 10 stops cooking, OVEN icon 170 (shown in FIG. 2) will flash and "PAUSE" is displayed on display 132 (shown in FIG. 2) at the first line, microprocessor 202 will stop counting the actual cooking time until door 12 is closed and cooking appliance 10 continues to cook. When door 12 is closed in the pause, "START WHEN READY" is displayed on display 132 on the first line until START/PAUSE keypad 158 (shown in FIG. 2) is pressed again to continue cooking. Microprocessor 202 continually updates the actual cooking time until the actual cooking time is saved or erased, such that, microprocessor 202 automatically determines 308 the actual cooking time.

When the operator finishes cooking, microprocessor 202 (shown in FIG. 3) prompts the operator on display 132 (shown in FIG. 2) to save the determined actual cooking time 310, or to delete the actual cooking time. More specifically, each time door 12 (shown in FIG. 2) is opened or closed, and audible alarm is sounded, and "Press FAVORITE RECIPES pad to SAVE or press the CLEAR pad to erase" will Scroll & Cycle on display 132 at the first line for several minutes, and the determined actual cooking time and the upper and lower power levels are displayed on display 132 at the second line at the same time. If CLEAR/OFF keypad 160 (shown in FIG. 2) is pressed during this scrolling display, the data will be erased. If the operator decides to save the actual time, the actual cooking time can be saved in a favorite recipes database that is electrically coupled to cooking appliance 10 (shown in FIG. 1), and the favorite recipes database is stored in permanent memory 206 (shown in FIG. 3) for future utilization. More specifically, if FAVORITE RECIPES keypad 154 (shown in FIG. 2) is pressed during this scrolling display, "Spell the FOOD NAME" will be displayed on display 132. When the spelling of the food name is completed, OVEN icon 142 (shown in FIG. 2) and TURN TO SELECT icon 172 (shown in FIG. 2) are turned off, a recipe including the food name, the determined actual cooking time and the upper and lower power levels are saved in the favorite recipes database, and "RECIPE ADDED to" will be displayed on display 132 at the first line for several seconds.

Cooking time can be easily adjusted by rotating dial, which provides a simple and direct way to adjust cooking time. Using the "resume" function to add a second cooking time to the first cooking time, and the second cooking time is set at a predetermined percentage of the actual cooking time, which allows the operator to easily achieve the correct cooking time during future operation. Using the microprocessor to determine the actual cooking time helps the operator to determine an optimal cooking time for creating a specific food recipe, and avoids a plurality of cooking iterations for reaching the optimal cooking time.

While the invention has been described in terms of various specific embodiments, those skilled in the art will recognize that the invention can be practiced with modification within the spirit and scope of the claims.

What is claimed is:

1. A method of operating a cooking appliance including an input interface panel and a processor, said method comprising:

inputting a first cooking time and a first cooking power level;

manually changing the first cooking time such that the first cooking time is at least one of extended and shortened;

automatically determining an actual cooking time using the processor;

prompting an operator to save the actual cooking time; and saving the actual cooking time in a database that is electrically coupled to the cooking appliance.

2. A method in accordance with claim 1 wherein saving the actual cooking time in a database comprises saving the actual cooking time in a favorite recipes database.

3. A method in accordance with claim 1 wherein inputting the first cooking time comprises prompting an operator to manipulate a dial on the input interface panel.

4. A method in accordance with claim 1 wherein inputting the first cooking time comprises rotating a dial on the input interface panel, wherein rotating the dial in a first direction increases the first cooking time, and rotating the dial in a second direction decreases the first cooking time.

5. A method in accordance with claim 4 wherein inputting the first cooking time further comprises pressing the dial to enter the first cooking time.

6. A method in accordance with claim 1 wherein manually changing the first cooking time comprises adding a second cooking time to the first cooking time, wherein the second cooking time is approximately 10 percent of the first cooking time.

7. A method in accordance with claim 1 wherein determining the actual cooking time comprises updating the actual cooking time until the actual cooking time is at least one of saved and erased based on an operator input.

8. A computer for operating a cooking appliance, said computer programmed to:

receive a first cooking time input and a first cooking power level input;

receive a second cooking time input that is based on an operator manually changing the first cooking time such that the first cooking time is at least one of extended and shortened;

automatically determine an actual cooking time using the computer; and prompt an operator to save the actual cooking time in a database that is electrically coupled to the cooking appliance based on operator input.

9. A computer in accordance with claim 8 further programmed to continually update the actual cooking time until the actual cooking time is saved or erased upon the operator input.

10. A computer in accordance with claim 8 further programmed to add a second cooking time to the first cooking time, wherein the second cooking time is a predetermined percentage of the actual cooking time.

11. A cooking appliance, comprising:

at least one cooking element; and a computer electrically coupled to said at least one cooking element, said computer programmed to:

receive a first cooking time input and a first cooking power level input;

receive a second cooking time input that is based on an operator manually changing the first cooking time such that the first cooking time is either extended or shortened; and automatically determine an actual cooking time using said computer;

wherein said computer is programmed to prompt an operator to save the determined actual cooking time, and save the actual cooking time in a favorite recipes database that is electrically coupled to said cooking appliance based on the operator input.

12. A cooking appliance in accordance with claim 11 wherein said computer is programmed to add or subtract the second cooking time input to or from the first cooking time based on the operator input such that the first cooking time is either extended or shortened.

13. A cooking appliance in accordance with claim 11 wherein said computer is programmed to add the second cooking time to the first cooking time, the second cooking time is set at a predetermined percentage of the actual cooking time.

14. A cooking appliance in accordance with claim 11 wherein when said cooking appliance stops cooking, said computer is programmed to stop counting the actual cooking time until said cooking appliance continues to cook.

15. A cooking appliance in accordance with claim 14 wherein said cooking appliance further comprises an oven having a door, when said door is opened, said oven stops cooking, and said computer is programmed to stop counting the actual cooking time until said door is closed and said oven continues to cook.

16. A cooking appliance in accordance with claim 11 wherein said cooking appliance further comprises an input interface panel having a dial, the first cooking time is input by operating said dial, rotating said dial in one a first direction increases the first cooking time, and rotating said dial in a second direction decreases the first cooking time.

17. A cooking appliance in accordance with claim 16 wherein rotation of said dial changes the first cooking time at a first ratio when the first cooking time is within a first time range, rotation of said dial changes the first cooking time at a second ratio when the first cooking time is within a second time range different than said first time range, the second ratio is greater than the first ratio, and the second time range is greater than the first time range.

* * * * *